US007685791B2

(12) United States Patent
Nahlen et al.

(10) Patent No.: US 7,685,791 B2
(45) Date of Patent: Mar. 30, 2010

(54) ARM CONNECTION FOR A STRUCTURAL MEMBER

(75) Inventors: David J. Nahlen, Germantown, TN (US); Michael R. Gall, Cordova, TN (US)

(73) Assignee: Thomas & Betts International, Inc., Wilmington, DE (US)

( * ) Notice: Subject to any disclaimer, the term of this patent is extended or adjusted under 35 U.S.C. 154(b) by 8 days.

(21) Appl. No.: 12/231,190

(22) Filed: Aug. 29, 2008

(65) Prior Publication Data

US 2009/0126284 A1 May 21, 2009

Related U.S. Application Data

(63) Continuation-in-part of application No. 11/655,355, filed on Jan. 19, 2007, now abandoned.

(51) Int. Cl.
*E04H 12/00* (2006.01)

(52) U.S. Cl. ..... 52/651.01; 52/651.02; 52/40; 248/219.3; 248/512

(58) Field of Classification Search ..... 52/40, 52/736.2, 721, 651.02; 248/219.3, 512, 548
See application file for complete search history.

(56) References Cited

U.S. PATENT DOCUMENTS

| | | | | |
|---|---|---|---|---|
| 2,721,362 | A | 10/1955 | McCoy et al. | |
| 3,265,415 | A | 8/1966 | Wubbe | |
| 3,509,678 | A | 5/1970 | Dake | 52/721 |
| 3,571,991 | A | 3/1971 | Doocy et al. | |
| 4,314,434 | A | 2/1982 | Meisberger | 52/721 |
| 5,228,260 | A | 7/1993 | Dziedzic | 52/697 |
| 5,605,017 | A | 2/1997 | Fingerson et al. | 52/40 |
| 5,855,103 | A | 1/1999 | Moore | 52/651.02 |
| 6,185,303 | B1 | 2/2001 | Losey | 379/454 |
| 6,312,264 | B1 | 11/2001 | Franz et al. | 439/76.1 |
| 6,626,406 | B1 | 9/2003 | Olson, Jr. | 248/219.3 |
| 6,685,154 | B1 | 2/2004 | Blyth et al. | 248/512 |
| 6,694,700 | B1 * | 2/2004 | Mackett | 52/764 |
| 6,857,615 | B2 | 2/2005 | Puckett et al. | 248/548 |
| 6,971,212 | B1 | 12/2005 | Johnson et al. | 52/651.02 |
| 7,057,103 | B1 | 6/2006 | Peabody | 174/45 |
| 7,240,464 | B2 * | 7/2007 | Oliphant et al. | 52/649.4 |

* cited by examiner

*Primary Examiner*—Richard E Chilcot, Jr.
*Assistant Examiner*—Mark R Wendell
(74) *Attorney, Agent, or Firm*—G. Andrew Barger

(57) ABSTRACT

A structural member and method with an improved arm connection is provided that allows quick connection of an arm to the structural member. Bolts are inserted through aligned apertures in first and second thru-vangs, as well as an abutting arm bracket. A securement member is inserted through an aperture in the bolts that is transverse to the bolts. Last, an arm is secured to the arm bracket for support of electrical conductors strung thereon.

12 Claims, 9 Drawing Sheets

ARM CONNECTION FOR A STRUCTURAL MEMBER

RELATED REFERENCE

This is a Continuation-in-Part of U.S. application Ser. No. 11/655,355 filed Jan. 19, 2007 now abandoned.

FIELD OF THE INVENTION

In general, the present invention relates to structural members. More particularly, the present invention relates to improved arm connections for structural members such as electrical transmission and distribution poles that support electrical conductors above ground.

BACKGROUND

Structural members such as electrical transmission poles have been used for decades to run electrical conductor high above the ground to span great distances. The method has proven less costly and less time consuming than running electrical conductors underground where numerous obstructions are encountered and rights of way needed. Arms are connected to the structural members to hold the electrical conductors away from the structural member high above the ground. The arms are also typically long and heavy since they must support the weight of multiple electrical conductors at all times and especially during storms. Ice can also build up on the conductors and add even more weight to the conductors and arms.

Currently the arms are welded to a bracket that has a plurality of apertures through each side. The bracket abuts, on its inside surface, two thru-vangs that extend through the center of the structural member and are welded thereto. Each thru-vang also has a plurality of apertures through each side that align with the apertures in the U-shaped bracket. Once the apertures of the brackets and thru-vangs are aligned, the arms are connected onto these structural members by the use of numerous large bolts. Contractors typically install the bolts while the structure is lying on the ground. The numerous bolts are so large (typically 1.5 inches or greater in diameter), the abutting thru-vangs and arm brackets so thick (typically 2 inches or more) that the connection of the arm to the thru-vangs is time consuming and requires great force. Tightening of the bolts necessitates the use of heavy torquing wrenches are used to tighten the bolts. The odd size of the bolts makes them difficult to purchase on the open market if one is lost. What's more, the number of bolts required for a secure arm connection takes a considerable amount of time. Last, there may be insufficient clearance for the torquing wrenches to be received inside the bracket, further delaying securement of the arms.

SUMMARY OF THE INVENTION

The present invention eliminates the above difficulties and disadvantages by providing a structural member that has at least one arm connection. The arm connection includes a first thru-vang extending laterally through the structural member and has a plurality of apertures disposed therein. The first thru-vang is secured to the structural member by welding. A second thru-vang is adjacent the first thru-vang and has a plurality of apertures therein. The second thru-vang extends laterally through the structural member and is welded thereto for securement. While it is disclosed that the thru-vangs extend laterally through the structural member, they can also be orientated in the vertical direction such that they extend longitudinally at least partially through the structure. Further, the plurality of apertures disposed in the first and second vangs may be threaded to receive a threaded bolt or pin therein.

At least one cross brace is joined between the first thru-vang and the second thru-vang for structural support. Preferably two cross braces are used and positioned such that they are spaced away from the structural member to allow for easier welding of the thru-vangs and/or the cross braces. Alternatively, a plurality of conduits are joined between each of the plurality of apertures of the first thru-vang and the second thru-vang for structural support and to aid in insertion of the plurality of pins. The plurality of conduits may be at least partially threaded to receive a threaded bolt or rod therein.

A plurality of pins are received through the plurality of apertures in the first thru-vang and the plurality of apertures in the second thru-vang which are axially aligned. Disposed on each end of the pins are threaded bolt and nuts that retain the pins within the bracket/vang apertures. A cotter or hitch pin could also be used for the pins.

An arm bracket is coupled to the first thru-vang and the second thru-vang by the plurality of pins such that each of the plurality of pins extends between the first thru-vang and the second thru-vang. Finally, an arm is secured to the arm bracket for suspending electrical conductors above the ground.

DETAILED DESCRIPTION OF THE PREFERRED EMBODIMENT(S)

Figure 1:
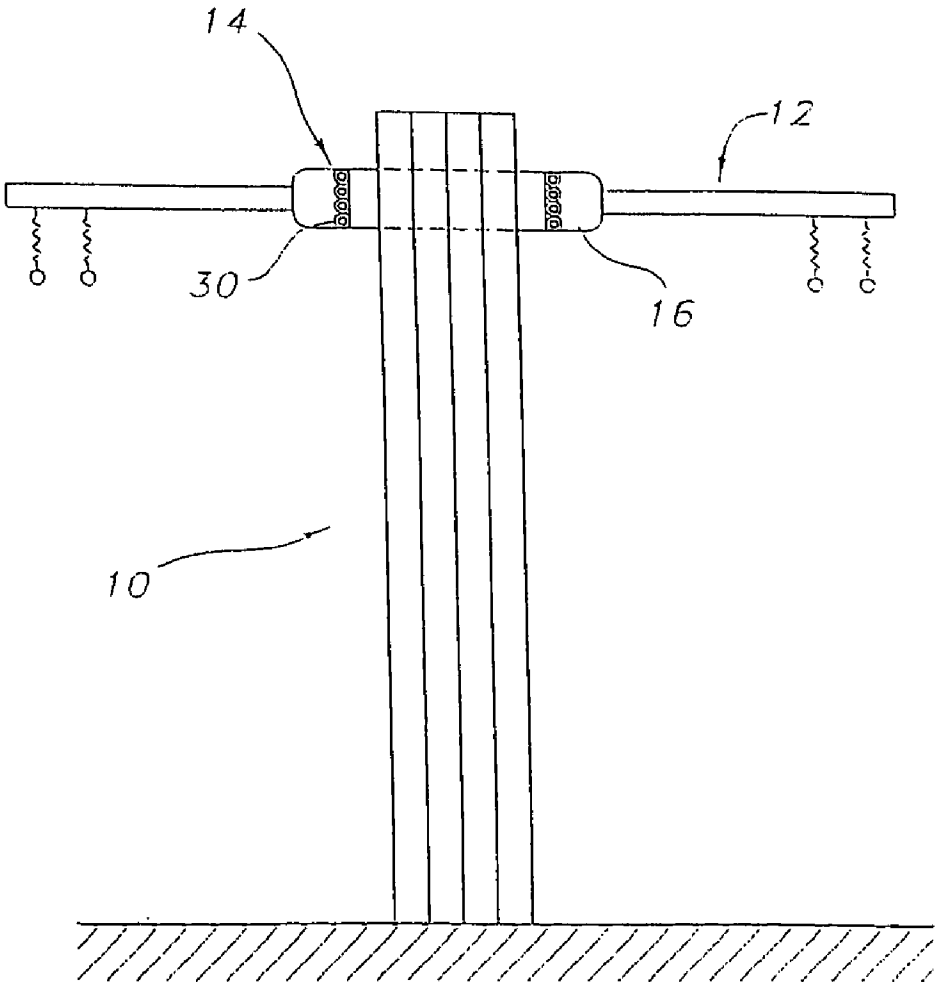
FIG. 1 (PRIOR ART)
FIG. 1 is a side elevational view of a prior art arm connection for a structural member.

The above and other features, aspects, and advantages of the present invention will now be discussed in the following detailed description of preferred embodiments and appended claims, which are to be considered in conjunction with the accompanying drawings in which identical reference characters designate like elements throughout the views.

Figure 2:
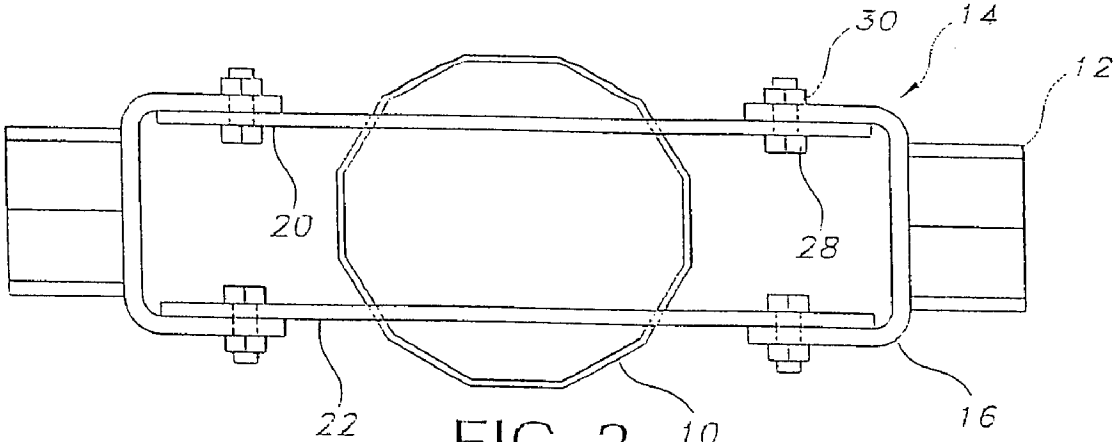
FIG. 2 (PRIOR ART)
FIG. 2 is a plan view of a prior art arm connection for a structural member.
Figure 3:
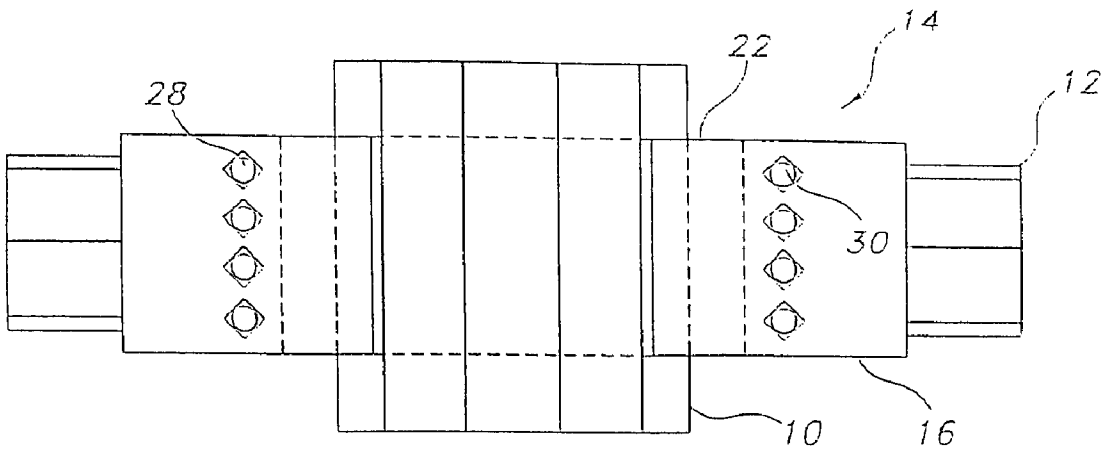
FIG. 3 (PRIOR ART)
FIG. 3 is a side elevational view of a prior art arm connection for a structural member.

Shown in FIG. 1 is a typical structural member 10 that is used in the electrical transmission industry to suspend electrical conductors above the ground via arms 12 that are welded to an arm bracket 16, which is secured to the structural member 10. More particularly, as shown in FIGS. 2 and 3, the arm bracket 16 is secured to the structural member 10 at arm connection 14. During field installation of the arms 12, the arm bracket 16 is positioned such that it abuts a first thru-vang 20 and a second thru-vang 22 and they are bolted together. This is accomplished by the use of typically sixteen threaded bolt 28 and nut 30 combinations that are inserted through aligned apertures 24 disposed in the arm bracket 16 and first and second thru-vangs 20, 22, respectively. The great number of these bolts 28 and nuts 30 make it easy for one or more to get lost during shipping or during connection of the arms 12. These bolts 28 are usually 1.5 inches in diameter and large torque wrenches must be used to tighten them. In addition, it is difficult to get the large torque wrenches inside the arm connection 14 to tighten the bolts 28 from the interior of the arm connection 14.

Figure 4:
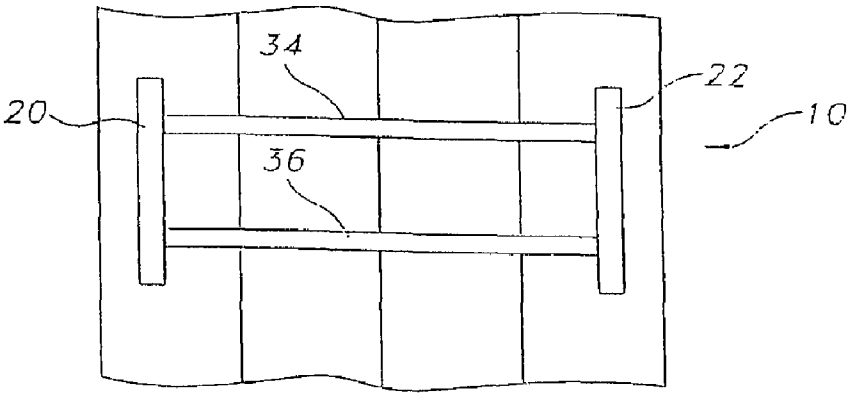
FIG. 4 is a front elevational view of a thru-vang for a structural member of the present invention.
Figure 5:
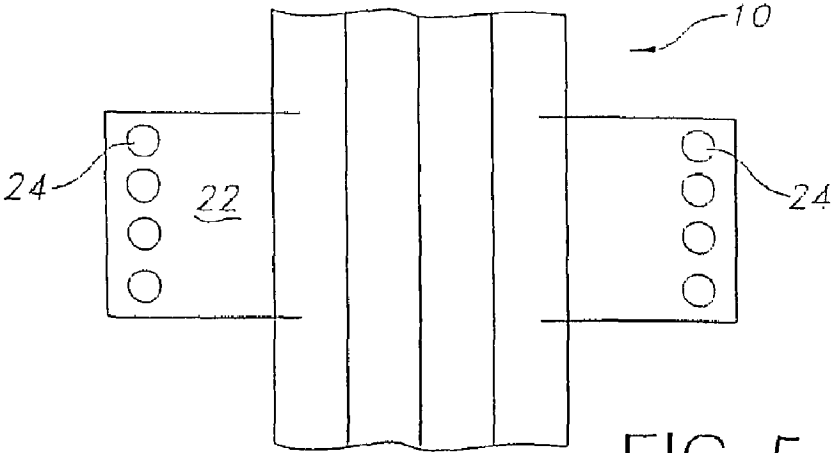
FIG. 5 is a side elevational view of a thru-vang for a structural member of the present invention.

The present invention, as shown in FIGS. 4-8, eliminates the above difficulties and disadvantages by providing a structural member 10 that has at least one arm connection 14, but preferably two arm connections 14. The arm connection 14 includes a first thru-vang 20 extending laterally through the structural member 10 and has a plurality of apertures 24 disposed therein, as is best seen in FIG. 5. The first thru-vang 20 is constructed of steel and preferably secured to the structural member 10 by welding. To install the first thru-vang 20 into the structural member 10, laterally spaced oval or rectangular apertures are cut in the structural member 10. The first thru-vang 20 is inserted through the apertures so that it extends partially on either side of the structural member 10 and then the first thru-vang 20 is welded on both sides where it extends from the cut apertures.

A second thru-vang 22 is adjacent the first thru-vang 20 and has a plurality of apertures 24 disposed therein. The second thru-vang 22 extends laterally through the structural member 10. Like the first thru-vang 20, the second thru-vang 22 is constructed of steel and is welded to the structural member 10 for securement. To install the second thru-vang 22 into the structural member 10, laterally spaced oval or rectangular apertures are cut in the structural member 10. The second thru-vang 22 is inserted through the apertures so that it extends partially on either side of the structural member 10 and then the second thru-vang 22 is welded on both sides where it extends from the cut apertures.

While it is disclosed that the thru-vangs extend laterally through the structural member 10, they can also be orientated in the vertical direction such that they extend longitudinally at least partially through the structure. Thru-vangs 20, 22 can also be of any general shape. Further, the plurality of apertures 24 disposed in the first and second vangs 20, 22, respectively, may be threaded to receive a threaded bolt or pin therein.

Figure 6:
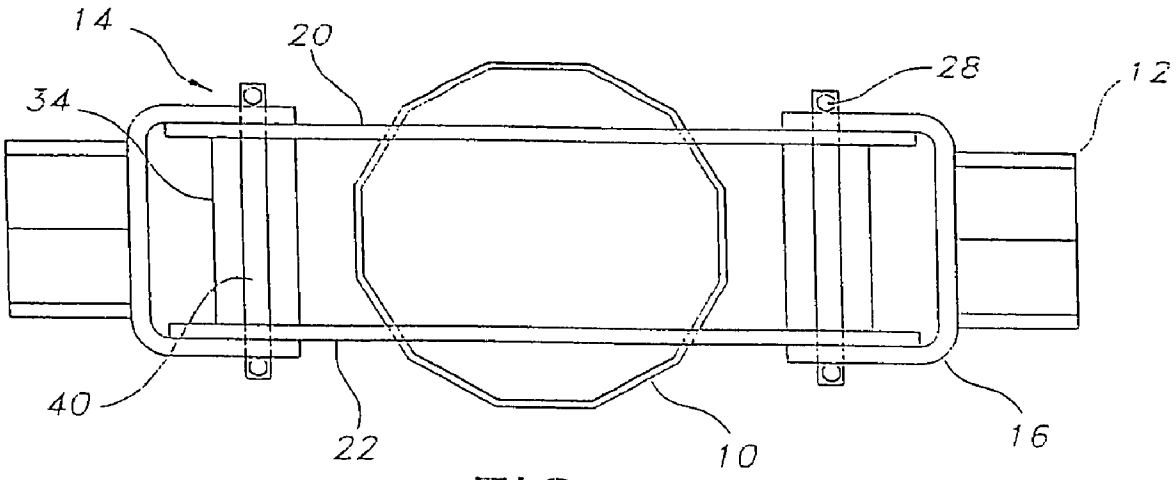
FIG. 6 is a plan view of an arm connection for a structural member of the present invention.
Figure 7:
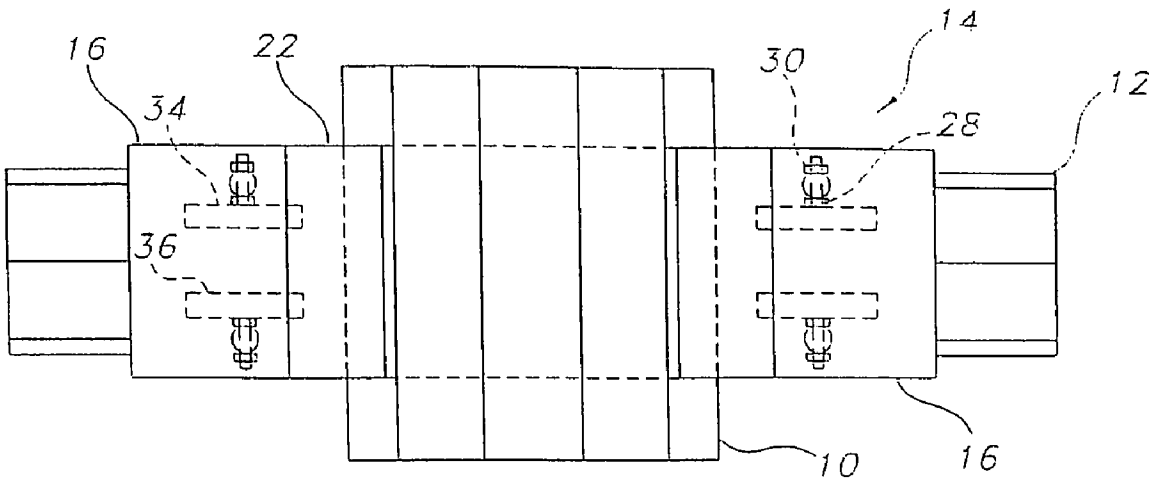
FIG. 7 is a side elevational view of an arm connection for a structural member of the present invention.

Turning now to FIG. 4, at least one cross brace 34 is joined between the first thru-vang 20 and the second thru-vang 22 for structural support. Preferably a first cross brace 34 and a second cross brace 36 are used, and welded between the first and second thru-vangs 20, 22, respectively. As shown in FIGS. 6 and 7, the first cross brace 34 and a second cross brace 36 are positioned such that they are spaced away from the structural member 10 to allow for easier welding of the thru-vangs 20, 22 and/or the cross braces 34, 36, which are also constructed of steel. The first cross brace 34 and a second cross brace 36 also do not extend to the distal ends of the first and second thru-vangs 20, 22, respectively, and positioned such that they do not interfere with apertures 24 and the pins that inserted therethrough.

Figure 8:
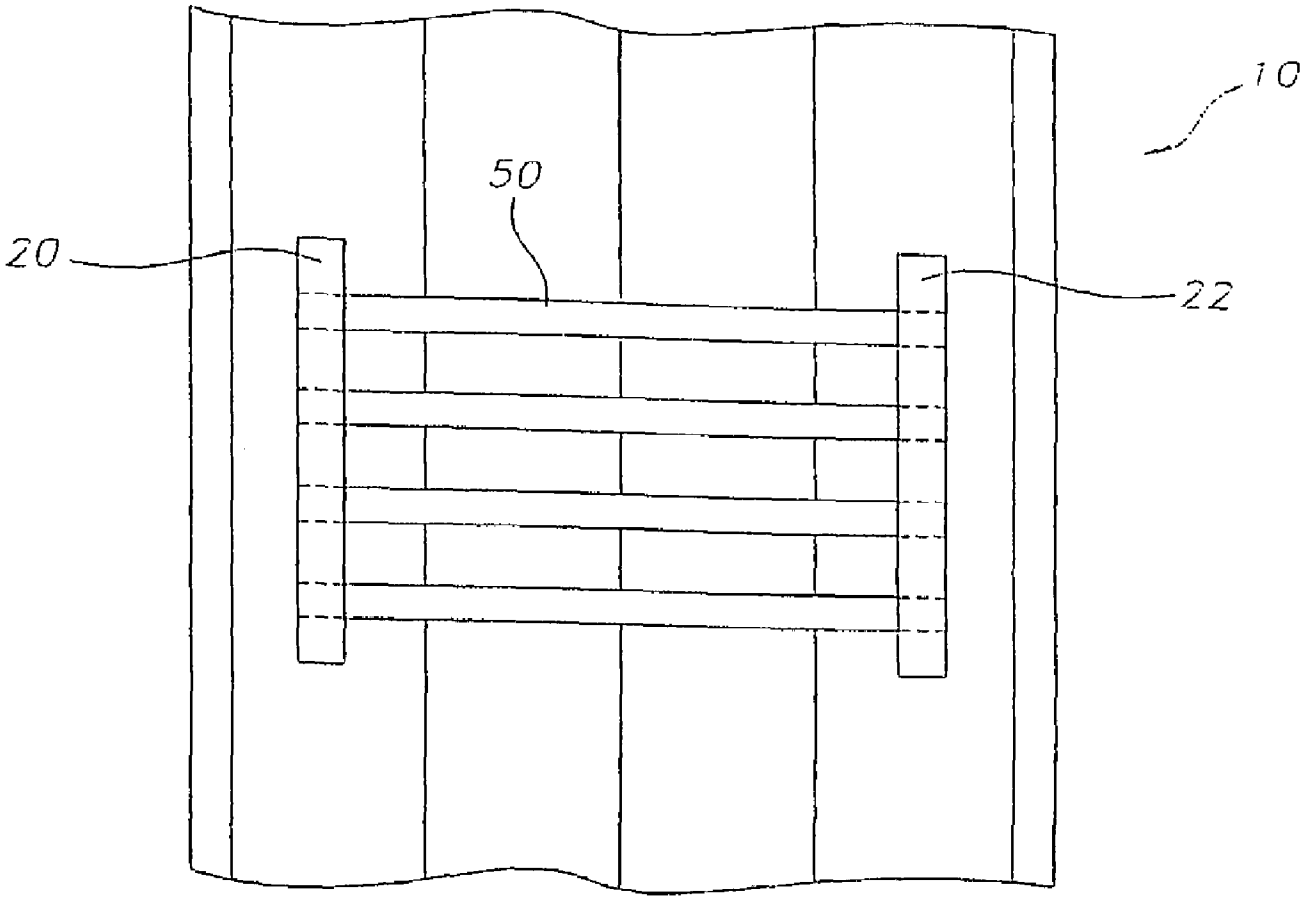
FIG. 8 is a front elevational view of an alternate embodiment thru-vang for a structural member of the present invention.

Alternatively, as shown in FIG. 8, a plurality of steel conduits 50 are joined between each of the plurality of apertures 24 of the first thru-vang 20 and the second thru-vang 22 for structural support and to aid in insertion of a plurality of pins 40 as will be discussed in further detail below. Specifically, the long pins 40 may be difficult to insert from an aperture in the first thru-vang 20 to an axially spaced and aligned aperture in the second thru-vang 22. Therefore, the conduits 50 provide easy insertion of the pins 40 therethrough. The plurality of conduits 50 may be at least partially threaded to receive a threaded bolt or rod therein. For instance, instead of an elongated pin, a short threaded bolt is screwed into the conduits 50 when internally threaded. The arm bracket 16 then rests on these bolts and asserts downward forces.

As stated above, a plurality of pins 40 are provided for establishing and securing the arm connection 14 of the structural member 10. Disposed on each end of the pins are preferably threaded bolts 28 and nuts 30, which are of standard size and can be easily tightened and replaced if one should get lost during shipping of the structural member 10 or during installation of the arms 12 if it is dropped in a field or in the mud. An aperture is disposed in each end of the pins 40 to receive the bolts 28 therethrough. It is appreciated that a cotter or hitch pin could also be used in place of the elongated pins 40 of the present invention.

An arm bracket 16, which is preferably U-shaped, is secured to the arm 12 by welding. The arm 12 is preferably constructed of steel along with bracket 16. The arm 12 suspends electrical conductors above the ground so that the electrical conductors can be ran over long spans. The arm bracket 16 is coupled to the first thru-vang 20 and the second thru-vang 22 by the plurality of pins 40 such that each of the plurality of pins 40 extends between the first thru-vang 20 and the second thru-vang 22. Specifically, to establish the arm connection 14, the bracket 16 is aligned with the first and second thru-vangs 20, 22, respectively, such that the apertures of each are aligned. A pin 40 is received through one of the plurality of apertures 24 in the bracket 16, through an aligned aperture in the first thru-vang 20, through an aligned aperture in the second thru-vang 22, and then through a similarly aligned aperture in the second thru-vang 22. Last, the threaded bolts 28 and nuts 30 are tightened on each end on the pin 40. This is repeated for each set of aligned apertures to form the arm connection. The threaded bolts 28 and nuts 30 retain the pins 40 within the arm connection 14 by preventing sliding of the pins 40 in the axial direction while downward forces of the arm bracket 16 are asserted on pins 40.

Figure 9:
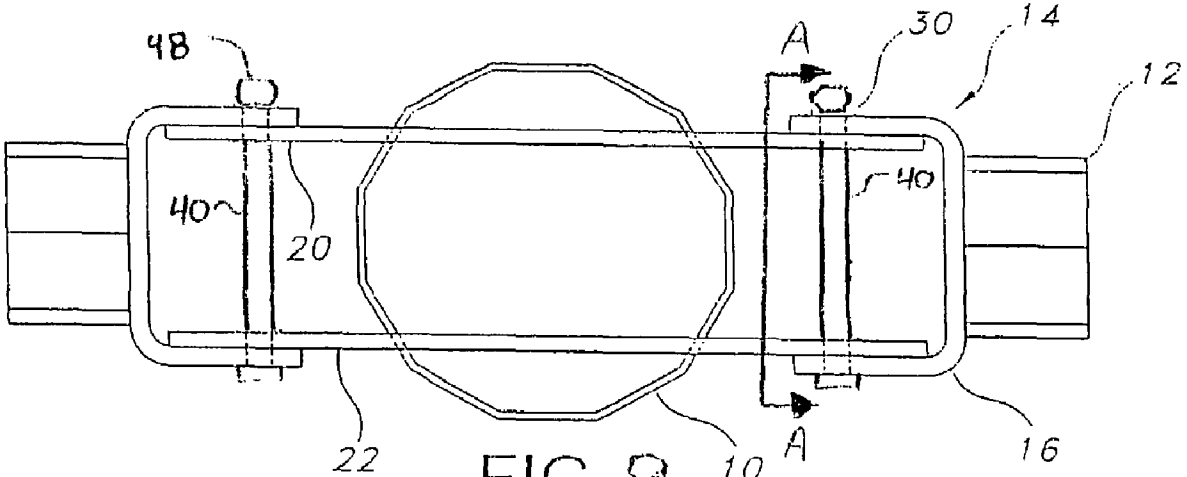
FIG. 9 is a plan view of a structural member of the present invention.
Figure 10:
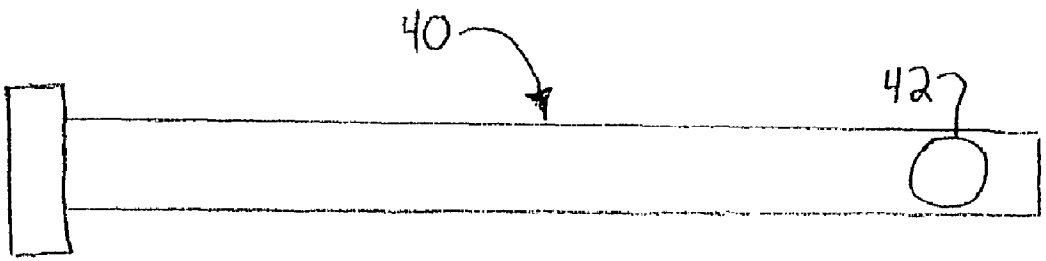
FIG. 10 is a long pin having an aperture of the present invention.
Figure 11:
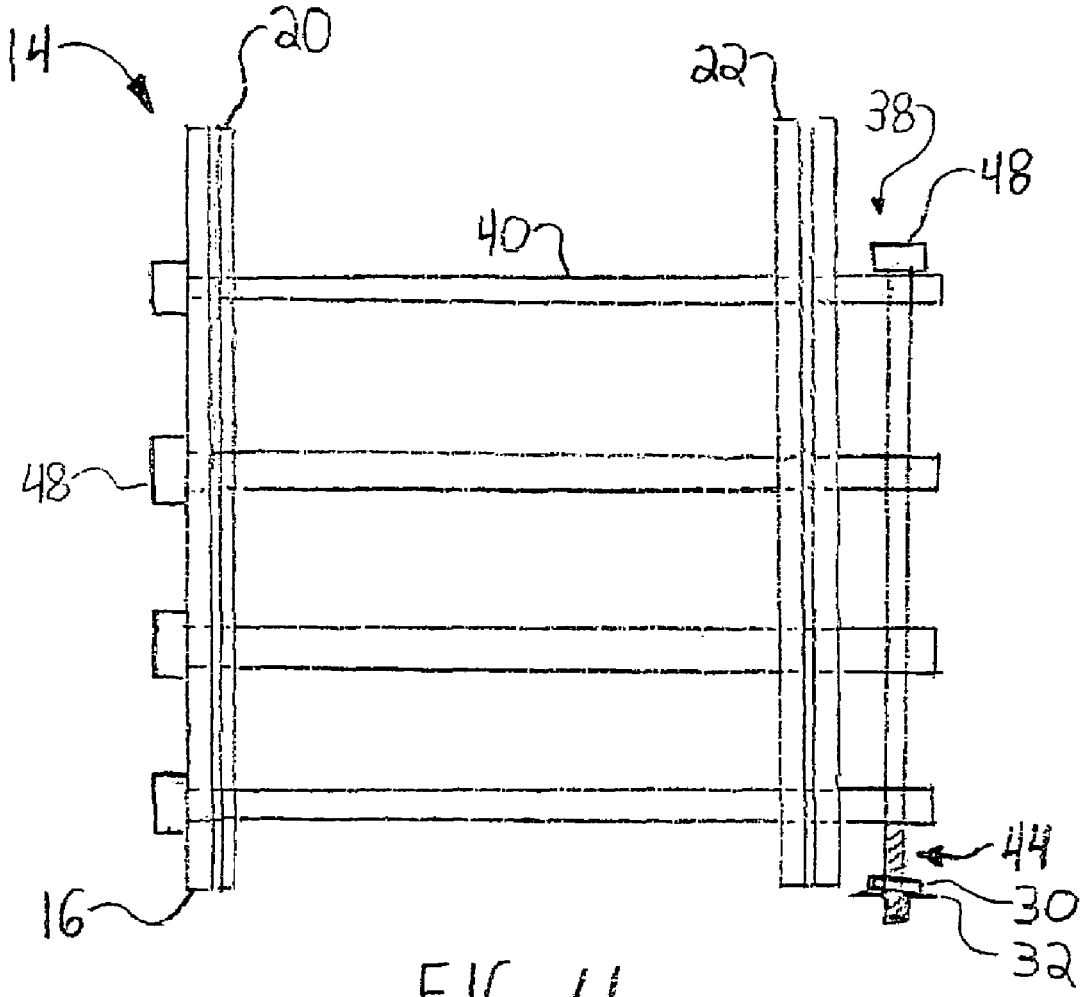
FIG. 11 is a side elevational view of an arm connection of the present invention taken along site line A-A of FIG. 9.

Shown in FIGS. 9-11 is an embodiment of the present invention a plurality of metal bolts are received through the apertures in the first thru-vang and the second thru-vang apertures. The arm has a bracket 16 into which a plurality of bracket apertures align with the first and second thru-vang apertures when the bracket 16 is aligned with the first and second thru-vangs. Preferably bracket 16 is disposed outside of the first and second thru-vangs, but can also be disposed inward of the first and second thru-vangs if desired.

As is best shown in FIG. 10, the plurality of bolts or long pins 40 have a head 48 on one end and the opposite end contains a securement aperture 42 disposed therein. Once the securement apertures 42 of each bolt 40 are vertically aligned, a securement member 38 is inserted down through the securement apertures 42 of the plurality of bolts 40 to prevent loosening of the plurality of bolts 40. The securement member 38 is preferably constructed of metal, but can also be constructed of strong, but lighter weight material than metal such as a thermo-formed plastic. As is best shown in FIG. 11, the securement member 38 is preferably a bolt that is threaded on one end 44 so that a nut 30 and lock washer 32 can be inserted on the threaded end 44. The securement member 38 is disposed transverse to the bolts 40 and releasably disposed within the securement apertures 42 of the plurality of bolts 40 for removal in the future if the arm connection 14 should need to be repaired or replaced.

Figure 12:
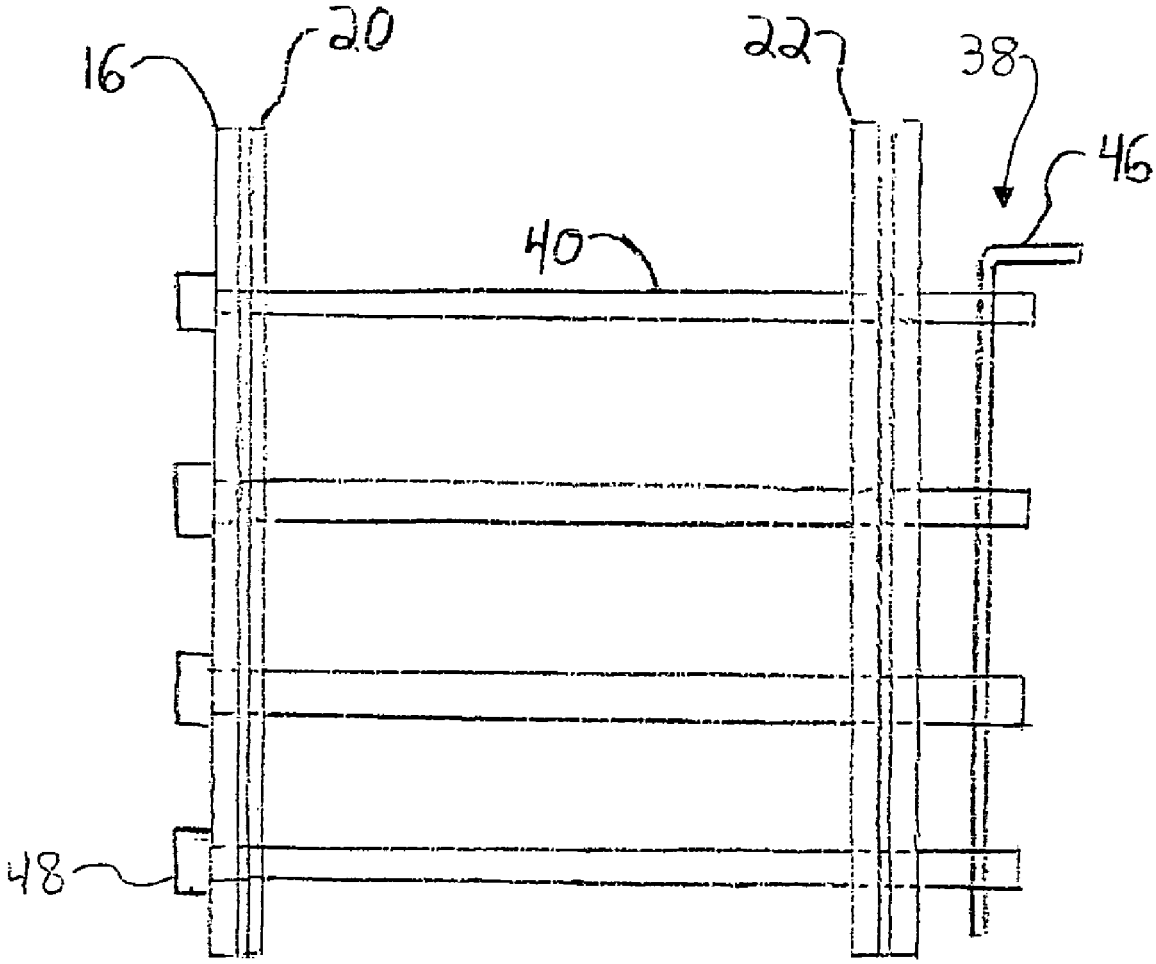
FIG. 12 is a side elevational view of an alternate embodiment of an arm connection of the present invention.

Shown in FIG. 12 is another embodiment of the present invention where the securement member 38 is a rod 46, which is preferably constructed of metal, with an angled end. Rod 46 can also be constructed of strong, but lighter weight material than metal such as a thermo-formed plastic. Once the securement apertures 42 of each bolt 40 are vertically aligned, the securement member 38 is inserted down through the securement apertures 42 of the plurality of bolts 40 to prevent loosening of the plurality of bolts 40. The securement member 38 is disposed transverse to the bolts 40 and releasably disposed within the securement apertures 42 of the plurality of bolts 40 for removal in the future if the arm connection 14 should need to be repaired or replaced.

Figure 13:
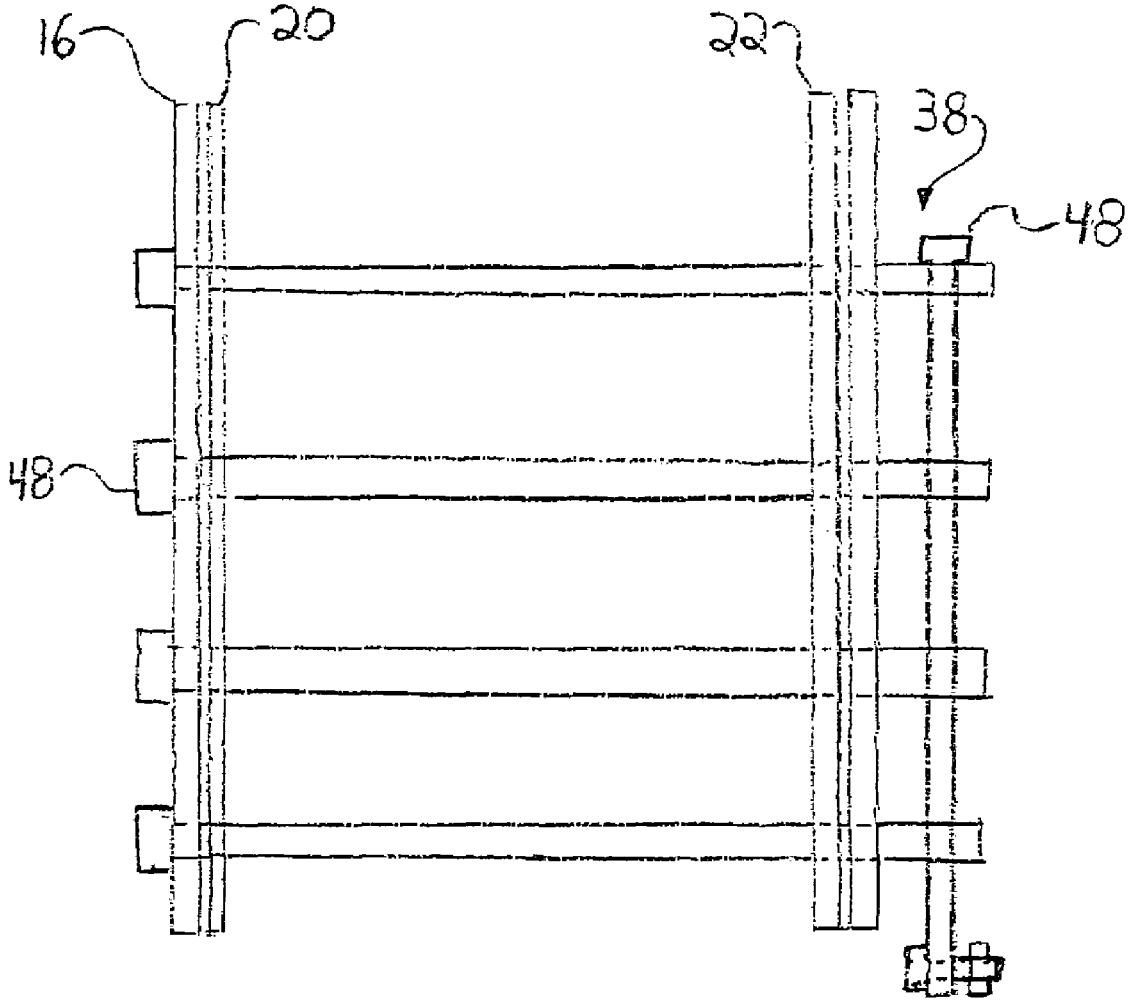
FIG. 13 is a side elevational view of an alternate embodiment of an arm connection of the present invention.

FIG. 13 shows securement member 38 consisting of a rod having an aperture disposed in one end for receiving a threaded bolt 28 therethrough such that a nut 30 is then installed onto the bolt 28. The rod can also be constructed of strong, but lighter weight material than metal such as a thermo-formed plastic. Once the securement apertures 42 of each bolt 40 are vertically aligned, the securement member 38 is inserted down through the securement apertures 42 of the plurality of bolts 40 to prevent loosening of the plurality of bolts 40. The securement member 38 is disposed transverse to the bolts 40 and is releasably disposed within the securement apertures 42 of the plurality of bolts 40 for removal in the future if the arm connection 14 should need to be repaired or replaced.

A method for installing an arm connection 14 on a structural member 10 is also provided. The method comprises the steps of first aligning the bracket apertures with apertures disposed in the first thru-vang and the second thru-vang 18. Next, a plurality of bolts 40 are inserted through the aligned first thru-vang and the second thru-vang apertures 24 and the bracket apertures. The plurality of bolts 40 contain a securement aperture 42 disposed therein. The final step of the current method is to insert a securement member 38 through the securement apertures 42 of the plurality of bolts 40 to prevent loosening of the plurality of bolts 40. Thus an arm connection 14 of the present invention can be made in three steps, which is a vast improvement over the prior art that can take over thirty steps to complete.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A structural member including an arm connection comprising:

a first thru-vang having a plurality of apertures disposed therein, the first thru-vang secured to the structural member;

a second thru-vang adjacent the first thru-vang and having a plurality of apertures therein, the second thru-vang secured to the structural member;

an arm bracket having a plurality of bracket apertures disposed therein and adjacent to the first thru-vang and the second thru-vang such that the bracket apertures align with apertures the first thru-vang and the second thru-vang;

a plurality of elongate bolts being received through the apertures in the first thru-vang and the second thru-vang apertures and the bracket apertures, each said bolt having a head at one end and a securement aperture at the other end, said securement apertures being aligned; and an elongate securement member inserted mutually through the aligned securement apertures of the plurality of bolts to prevent loosening of the plurality of bolts.

2. The structural member of claim 1 wherein the securement member is disposed transversally to the plurality of bolts when inserted through the securement apertures of the plurality of bolts.

3. The structural member of claim 1 wherein the securement member is releasably secured to the plurality of bolts.

4. The structural member of claim 1 wherein the securement member is a bolt that is threaded on at least one end for receiving a nut thereon.

5. The structural member of claim 1 wherein the securement member is a rod with an angled end to prevent the rod from sliding downward.

6. The structural member of claim 1 wherein the securement member is a rod having an aperture disposed therein.

7. A method for installing an arm connection on a structural member including a first thru-vang having a plurality of apertures disposed therein, the first thru-vang secured to the structural member, a second thru-vang adjacent the first thru-vang and having a plurality of apertures therein, the second thru-vang secured to the structural member, an arm bracket having a plurality of bracket apertures disposed therein and adjacent to the first thru-vang and the second thru-vang, the method comprising the steps of:

aligning the bracket apertures align with apertures the first thru-vang and the second thru-vang;

inserting a plurality of elongate bolts through the aligned first thru-vang and second thru-vang apertures and the bracket apertures, each said bolt having a head at one end and a securement aperture at the other end, said securement apertures being aligned; and inserting an elongate securement member mutually through the aligned securement apertures of the plurality of bolts to prevent loosening of the plurality of bolts.

8. The method of claim 7 wherein the securement member is disposed transversally to the plurality of bolts when inserted through the securement apertures of the plurality of bolts.

9. The method of claim 7 wherein the securement member is releasably secured to the plurality of bolts.

10. The method of claim 7 wherein the securement member is a bolt that is threaded on at least one end for receiving a nut thereon.

11. The method of claim 7 wherein the securement member is a rod with an angled end to prevent the rod from sliding downward.

12. The method of claim 7 wherein the securement member is a rod having an aperture disposed therein.

* * * * *